US008873342B1

(12) United States Patent
Boudreaux et al.

(10) Patent No.: US 8,873,342 B1
(45) Date of Patent: Oct. 28, 2014

(54) LOCAL-TIME AWARE MULTI-DISPLAY WRISTWATCH

(71) Applicant: UCB Industries, LLC, Phoenix, AZ (US)

(72) Inventors: Ursula Blackshere Boudreaux, Henderson, NV (US); Ian D. Kovacevich, Charlotte, NC (US); Daniel Lee Bizzell, Charlotte, NC (US)

(73) Assignee: UCB Industries, LLC, Charlotte, NC (US)

( * ) Notice: Subject to any disclaimer, the term of this patent is extended or adjusted under 35 U.S.C. 154(b) by 0 days.

(21) Appl. No.: 13/775,148

(22) Filed: Feb. 23, 2013

Related U.S. Application Data

(63) Continuation of application No. 12/874,193, filed on Sep. 1, 2010, now abandoned, which is a continuation-in-part of application No. 12/873,304, filed on Aug. 31, 2010, now abandoned.

(60) Provisional application No. 61/238,673, filed on Aug. 31, 2009.

(51) Int. Cl.
*G04C 11/00* (2006.01)
*G04B 19/22* (2006.01)

(52) U.S. Cl.
CPC ..... *G04B 19/22* (2013.01)
USPC ..... 368/47; 368/46

(58) Field of Classification Search
USPC ..... 368/21
See application file for complete search history.

(56) References Cited

U.S. PATENT DOCUMENTS

| | | | | |
|---|---|---|---|---|
| 5,440,559 | A * | 8/1995 | Gaskill | 370/314 |
| 6,278,660 | B1 * | 8/2001 | Tognazzini | 368/21 |
| 8,116,170 | B2 * | 2/2012 | Matsuzaki | 368/47 |
| 8,284,633 | B2 * | 10/2012 | Lazaridis et al. | 368/109 |
| 2003/0067844 | A1 * | 4/2003 | Liaw | 368/47 |

* cited by examiner

*Primary Examiner* — Amy Cohen Johnson
*Assistant Examiner* — Jason Collins
(74) *Attorney, Agent, or Firm* — Tillman Wrigth, PLLC; Chad D. Tillman; Jeremy C. Doerre

(57) ABSTRACT

A wristwatch includes a face having a first area, in which the hour of the time associated with a first time zone is displayable; a second area, in which the hour of the time associated with a second time zone is displayable; and a third area, in which the minutes past the respective hours of the first and second time zones is displayable. The first area includes an analog display of an hour hand without a minute hand; the second area includes an analog display of an hour hand without a minute hand; and the third area includes an analog display of a minute hand without an hour hand. Each of the displays alternatively could be digital. Each of the areas preferably is compartmentalized and physically separated from the other areas on the face of the wristwatch.

19 Claims, 9 Drawing Sheets

LOCAL-TIME AWARE MULTI-DISPLAY WRISTWATCH

CROSS-REFERENCE TO RELATED APPLICATION

The present application is a U.S. continuation patent application of, and claims priority under 35 U.S.C. §120 to, U.S. nonprovisional patent application Ser. No. 12/874,193, filed Sep. 1, 2010, incorporated herein by reference, which '193 application is a U.S. continuation-in-part patent application of, and claims priority under 35 U.S.C. §120 to, U.S. nonprovisional patent application Ser. No. 12/873,304, filed Aug. 31, 2010, incorporated herein by reference, which '304 application is a U.S. nonprovisional patent application of, and claims priority under 35 U.S.C. §119(e) to, U.S. provisional patent application No. 61/238,673, filed Aug. 31, 2009, incorporated herein by reference. Additionally, FIGS. 9a-9h from the '193 application are included in the Appendix hereto, incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to chronometric apparatus and, in particular, multi-display chronometric apparatus that automatically update the current local time that is reflected on one of the displays when the chronometric apparatus travels into a different time zone. The automatic update may be done on demand by the user or programmatically.

Patent references are known that disclose mutli-display chronometers, including Hall U.S. Pat. No. 6,633,510; Hall U.S. Pat. No. 6,639,875; and Proellochs U.S. Pat. No. 4,444,513. Other patent references are know that disclose wearable chronometers having GPS receivers and/or wireless communication capabilities for communication with and over networks such as the Internet. Such other references include Neher U.S. Pat. No. 6,362,778; and Odagiri U.S. Pat. No. 5,905,460. Each of these references is incorporated herein by reference.

Even in view of these known references, however, it is believed that a need exists for improvement in time keeping devices that automatically update to reflect current local time in which the user is located while simultaneously allowing the user to continue viewing the current local time in a different time zone. Specifically, it is believed that such a need is felt by business travelers who frequently travel between different time zones. While broadcast technology exists to synchronize time keeping devices to a reference—such as an atomic clock—for accurate minutes and seconds, the correct time zone and date generally must still be known in order to accurately reflect the hour, especially in areas near time zone borders. Other wireless technological solutions exist that rely on access to wireless networks, including cellular networks by which phones are updated when they travel into different time zones. Still, none of the technologies and related devices are believed to include multi-display chronometric apparatus either having the capability of automatically the current local time that is reflected on one of the displays that is selected by the user, or having the capability of automatically updating the current local time on demand by the user when the chronometric apparatus travels into a different time zone. The need for improvement—including the provision of one or more of these and other capabilities—is addressed by one or more aspects or features of the present invention.

SUMMARY OF THE INVENTION

The present invention includes many aspects and features. Moreover, while many aspects and features relate to, and are described in, the context of multi-display wristwatches, the present invention is not limited to use only in such context, as will become apparent from the following summaries and detailed descriptions of aspects, features, and one or more embodiments of the present invention.

Accordingly, in a first aspect of the invention, a local-time aware, multi-display chronometric apparatus includes: a first display for displaying time associated with a first time zone; a second display for displaying time associated with a second time zone; and a timekeeping assembly comprising at least one timekeeping component configured to keep time, the time keeping assembly arranged such that the passing of time is displayed by the first display and the second display. The timekeeping assembly includes a receiver configured to receive a signal by which a local time of the area in which the chronometric apparatus is geographically located may be determined. The timekeeping assembly further includes an updater configured to update at least one of the first display and the second display with the local time; and the timekeeping assembly includes a control by which a user of the chronometric apparatus selects for updating, by the updater, at least one of the first display and the second display for displaying the local time as determined by a signal received by the receiver.

In a feature of this aspect, only one of the first display and the second display is selectable at a time, via the control, for displaying the local time.

In a feature of this aspect, selection of the first display, via the control, for displaying the local time causes the second display to display a time associated with a predetermined time zone.

In a feature of this aspect, selection of the second display, via the control, for displaying the local time causes the first display to display a time associated with a predetermined time zone. Moreover, selection of the first display, via the control, for displaying the local time causes the second display to display a time associated with a predetermined time zone. Preferably, the predetermined time zone corresponds to the time zone that encompasses the home of the user.

In another feature, the timekeeping assembly automatically receives the signals and updates at least one of the first and second displays to display the local time as determined by the received signal without prompting by the user.

In another feature, the timekeeping assembly receives the signals and updates at least one of the first and second displays to display the local time as determined by the received signal upon prompting by the user.

In another feature, the timekeeping assembly receives the signals and updates at least one of the first and second displays to display the local time as determined by the received signal only upon prompting by the user.

In another feature, the chronometric apparatus includes a transmitter configured to transmit a signal indicative of the local time.

In another feature, the chronometric apparatus includes a transmitter configured to blindly transmit signals indicative of the local time at periodic intervals for receipt by other chronometric apparatus.

In another feature, the chronometric apparatus includes a transmitter configured to transmit to other chronometric apparatus signals indicative of the local time. The chronometric apparatus includes a control, operable by the user, for activating and deactivating the transmitter.

In another aspect of the invention, a local-time aware, multi-display chronometric apparatus includes: a first display for displaying time associated with a first time zone; a second display for displaying time associated with a second time zone; and a timekeeping assembly comprising at least one timekeeping component configured to keep time, the time keeping assembly arranged such that the passing of time is displayed by the first display and the second display. The timekeeping assembly includes a receiver configured to receive a signal by which a local time of the area in which the chronometric apparatus is geographically located may be determined. The timekeeping assembly further includes an updater configured to update at least one of the first display and the second display with the local time. The chronometric apparatus further includes a control by which a user of the chronometric apparatus causes the timekeeping assembly to receive the signal, via the receiver, and to update at least one of the first display and the second display, via the updater, with the local time as determined by the received signal.

In a feature, only one of the first display and the second display is selectable at a time, via the control, for displaying the local time.

In a feature, the control causes only one of the first and second displays to display the local time as determined by the received signal and updated by the updater, and wherein the time displayed by the other display is not changed thereby.

In a feature, the first display and the second display are selectable, by the user, for displaying the local time as determined by a signal received by the receiver and updated by the updater.

In a feature, only one of the first display and the second display is selectable at a time, by the user, for displaying the local time as determined by a signal received by the receiver.

In a feature, the timekeeping assembly has a high power consumption when receiving a signal and updating at least one of the first and second displays; the timekeeping assembly operates in a reduced power consumption mode when not receiving a signal and updating at least one of the first and second displays; and the timekeeping assembly receives the signal and updates at least one of the first and second displays in response to actuation of the control by the user, whereby the timekeeping assembly operates a majority of the time in the reduced power consumption mode.

In a feature, the timekeeping assembly further comprises a processor that processes the signal received by the receiver for determining the local time.

In a feature, the timekeeping assembly further comprises integrated circuitry that processes the signal received by the receiver for determining the local time.

In a feature, the timekeeping assembly further comprises an ASIC that processes the signal received by the receiver for determining the local time.

In a feature, the timekeeping assembly comprising a first timekeeping component configured such that the first display shows the passing of time as determined by the first timekeeping component, and a second timekeeping component configured such that the second display shows the passing of time as determined by the second timekeeping component. In an alternative feature, a single timekeeping component is configured such that both the first display and the second display show the passing of time as determined by the single timekeeping component.

In a feature, the first display comprises a face of an analog clock having a minute hand and an hour hand, and wherein the second display comprises a face of an analog clock having a minute hand and an hour hand. The faces of the analog clocks of the first and second displays may be virtual or may be physical. Furthermore, updating of at least one of the first displays and the second displays preferably includes rapid movement (forward or backward) of the minute hand of the respective display that is updated.

In a feature, the updater is hardware, software, or a combination thereof.

In a feature, the receiver comprises an RF receiver.

In a feature, the receiver comprises a GPS receiver.

In a feature, the receiver comprises a Bluetooth receiver.

In a feature, the receiver comprises a WiFi receiver.

In a feature, the selector comprises a button of a touchscreen.

In a feature, the selector comprises a control knob.

In a feature, the selector comprises a depressable button.

In a feature, the chronometric apparatus comprises a wristwatch.

In a feature, the chronometric apparatus comprises a portable clock.

In a feature, the chronometric apparatus is part of an automobile.

In a feature, the chronometric apparatus is part of a ship.

In a feature, the chronometric apparatus comprises a marine clock.

In a feature, the chronometric apparatus is part of an airplane.

In a feature, the chronometric apparatus comprises a handheld electronic device.

In a feature, the chronometric apparatus comprises a cellular phone.

In a feature, the chronometric apparatus comprises a personal digital assistant.

In a feature, the chronometric apparatus comprises a smartphone.

In a feature, the chronometric apparatus comprises a consumer electronic device including, for example, an Apple iPhone or Palm Pre.

In another aspect, a method of keeping time includes the steps of: causing a local-time aware, multi-display chronometric apparatus to travel from a first time zone to a second time zone; and, when the local-time aware, multi-display chronometric apparatus is in the second time zone, causing the chronometric apparatus to update a first one of a plurality of time displays of the local-time aware, multi-display chronometric apparatus to display the current local time in the second time zone as determined by a signal that is received by the local-time aware, multi-display chronometric apparatus and that is indicative of the current local time in the second time zone.

In a feature, the method further includes the step of maintaining, on a second one of a plurality of time displays of the local-time aware, multi-display chronometric apparatus, the current local time in with the first time zone when traveling in the second time zone.

In a feature, the first display is selected from the plurality of time displays for being updated to the current local time in the second time zone.

In a feature, the first one of the plurality of time displays is updated on demand to the current local time in the second time zone.

In a feature, the chronometric apparatus includes a control by which a user causes to the first display to be updated on demand to the current local time in the second time zone.

In a feature, the method further includes the step of causing the first display of the local-time aware, multi-display chronometric apparatus for displaying the current local time zone in with the second time zone.

In a feature, the method further includes the steps of: causing the local-time aware, multi-display chronometric apparatus to travel from the second time zone to a third time zone; and when the local-time aware, multi-display chronometric apparatus is in the third time zone, causing the chronometric apparatus to update the second display of the local-time aware, multi-display chronometric apparatus to display the current local time in the third time zone as determined by a signal that is received by the local-time aware, multi-display chronometric apparatus and that is indicative of the current local time in the third time zone.

In this respect, the method also further includes the step of maintaining, on a second one of the plurality of time displays of the local-time aware, multi-display chronometric apparatus, the current local time in the first time zone when traveling in the third time zone.

In a feature, the signal is a radio frequency (RF) signal.

In a feature, the method further includes receiving the signal by an RF radio of the local-time aware, multi-display chronometric apparatus.

In a feature, the method further includes receiving the signal by a GPS receiver of the local-time aware, multi-display chronometric apparatus.

In a feature, the method further includes receiving the signal by a Bluetooth receiver of the local-time aware, multi-display chronometric apparatus.

In a feature, the method further includes receiving the signal by a WiFi receiver of the local-time aware, multi-display chronometric apparatus.

In a feature, the method further includes receiving the signal by a WiMax receiver of the local-time aware, multi-display chronometric apparatus.

In a feature, the signal identifies a geographical location of the local-time aware, multi-display chronometric apparatus from which the current local time is determined by the local-time aware, multi-display chronometric apparatus; and the local-time aware, multidisplay chronometric apparatus is configured to determine the current local time of the third time zone based on the determination of the geographical location of the local-time aware, multi-display chronometric apparatus.

In a feature, the signal identifies the current local time in the second time zone.

In a feature, the signal identifies both a geographical location of the local-time aware, multi-display chronometric apparatus and a time in a predetermined reference time zone.

In a feature, the signal is received from another local-time aware, multi-display chronometric apparatus.

In a feature, the signal is received from a transmitter arranged in communication with a network.

In a feature, the signal is received from a transmitter arranged in wired communication with a network.

In a feature, the signal is received from a tower transmitter.

In a feature, the signal is received from a transmitter of a plane by which travelers in the plan may set the local time in the time zone in which the plane lands.

In a feature, the signal is received from a consumer electronic device that is also caused to travel from the first time zone to the second time zone.

The consumer electronic device may be a cellular phone or a smartphone, and the local-time aware, multi-display chronometric apparatus may communicate with the consumer electronic device over a Bluetooth communications link.

In yet another aspect, a system includes a plurality of chronometric apparatus, each including a display for displaying time. Moreover, each chronometric apparatus is configured to be carried on one's person, to transmit a signal indicative of the current local time as kept by the chronometric apparatus, to receive such signals from the other chronometric apparatus, and to update the current local time as kept by the chronometric apparatus based on the signals received from the other chronometric apparatus.

In a feature, the signal transmitted by each chronometric apparatus is blindly transmitted.

In a feature, the signal transmitted by each chronometric apparatus is transmitted to an identified recipient chronometric apparatus.

In a feature, the signal transmitted by each chronometric apparatus is transmitted to an identified recipient chronometric apparatus upon a request that is received from such chronometric apparatus.

In yet another aspect of the invention, a multi-display time keeping apparatus includes a first time keeping mechanism having a manual control and a home time display, wherein the manual control can set a time on the first time keeping mechanism which is communicated to a user via the home time display. An exemplary such apparatus further includes a second time keeping mechanism including a processor, a receiver, an on/off control, and a travel time display, wherein the on/off control activates the receiver allowing the receiver to receive a remote time signal, wherein the on/off control activates the processor allowing the processor to process the remote time signal and compute a current local time, and wherein the current local time, as computed by the processor, is communicated to a user via the travel display.

In a feature of this aspect of the invention, the remote time signal is transmitted by one or more Global Positioning System satellites. In another feature of this aspect of the invention, the apparatus is a wristwatch. In still another feature of this aspect of the invention, the receiver and processor stay activated until deactivated by the on/off control. Alternatively, the receiver and processor automatically deactivate after a predetermined time interval. Alternatively, the receiver and processor automatically deactivate after receiving and processing the remote time signal.

Another aspect of the invention relates to a multi-display time keeping apparatus. An exemplary such apparatus includes a first time keeping mechanism having a first processor, a first on/off control, a first time display, and a first manual control; a second time keeping mechanism having a second processor, a second on/off control, a second time display, and a second manual control; and a receiver. Furthermore, in this aspect of the invention, the first manual control can set a time on the first time display and the second manual control can set a time on the second time display. Still yet in this aspect, the first on/off control activates the first processor and the receiver and the second on/off control activates the second processor and the receiver. Further still, once activated, the receiver is capable of receiving a remote time signal. Furthermore, once activated, the first processor is capable of processing the remote time signal and computing a current local time to be displayed by the first time display, and, once activated, the second processor is capable of processing the remote time signal and computing a current local time to be displayed by the second time display.

In a feature of this aspect of the invention, the remote time signal is transmitted by one or more Global Positioning System satellites. In another feature of this aspect of the invention, the apparatus is a wristwatch. Alternatively, the apparatus may be an automobile clock, a marine clock, a aviation clock or a handheld electronic device, such as a cellular phone or a personal digital assistant. In another feature of the present invention, once activated, the first processor stays activated until deactivated by the first on/off control. In other feature, once activated, the second processor stays activated until deactivated by the second on/off control. In yet another feature, the receiver remains activated so long as either the first processor or the second processor remains activated. In still another feature, once deactivated, the receiver, first processor, and second processor automatically deactivate after a predetermined time interval. In yet another feature, once activated, the receiver, first processor, and second processor automatically deactivate after receiving and processing the remote time signal.

In still another aspect of the invention, a chronometric apparatus is provided with at least one of audio and video hardware and associated processing that allows the correct local time and/or location to be automatically detected or entered via user assistance, which subsequently adjusts the clock's time to maintain the correct local time.

In another aspect, a chronometric device is provided with a memory and graphical user interface that when executed allows a user to enter the location or relative location or correct local time and adjusts the clock's time to maintain the correct local time.

In another aspect of the invention, a wristwatch includes a case and a band for attaching the wristwatch onto a user's arm. The case includes a face having: a first area, in which information about time associated with a first time zone is displayable; a second area, in which information about time associated with a second time zone is displayable; and a third area, in which information about time associated with both the first time zone and the second time zone is displayable. The case also includes a timekeeping assembly having at least one timekeeping component by which the information about the time associated with the first time zone is maintained, the information about the time associated with the second time zone is maintained, and the information about the time associated with both the first and second time zones is maintained.

In a feature, the information about time associated with the first time zone comprises the hour of the time associated with the first time zone; the information about time associated with the second time zone comprises the hour of the time associated with the second time zone; and the information about time associated with both the first time zone and the second time zone comprises the minutes past the respective hours of the times of the first time zone and the second time zone. The first area may further include a display of an hour hand without a minute hand; the second area may further include a display of an hour hand without a minute hand; and the third area may further include a display of a minute hand without an hour hand. Furthermore, the display of the hour hand in the first area may be analog; the display of the hour hand in the second area may be analog; and the display of the minute hand in the third area may be analog. Alternatively, the three displays may be digital. The first area, the second area, and the third area of the face also may be compartmentalized and physically separate from one another on the face.

In another feature, the timekeeping assembly includes a first timekeeping component configured to keep time such that the information about the time associated with the first time zone is maintained; a second timekeeping component configured to keep time such that the information about the time associated with the second time zone is maintained; and a third timekeeping component configured to keep time such that the information about the time associated with both the first time zone and the second time zone is maintained.

In another feature, the case further includes a first manual control that enables a user to manually adjust the information about the time associated with the first time zone that is displayable in the first area. The case further may include a second manual control that enables a user to manually adjust the information about the time associated with the both first time zone and the second time zone that is displayable in the third area.

In another feature, the case further includes a manual update control that enables a user to cause on demand the information about the time associated with the second time zone that is displayable in the second area to be automatically updated.

In another feature, the time associated with the second time zone that is displayable in the second area comprises a local time of the area in which the wristwatch is geographically located; the case further comprises a receiver configured to receive a signal by which a local time of the area in which the wristwatch is geographically located may be determined; and the case further comprises an update control by which a user of the wristwatch causes the information about the time associated with the second time zone that is displayable in the second area to be automatically updated via the signal received by the receiver. The case also further may include a transmitter configured to transmit a signal indicative of the information about the time associated with the second time zone and, moreover, the transmitter may be configured to blindly transmit the signal at periodic intervals for receipt by other chronometric apparatus. Additionally or alternatively, the case may further include a control, operable by the user, for activating and deactivating the transmitter.

Preferably, with regard to this feature, the wristwatch has a high power consumption when receiving a signal and updating the information about the time associated with the second time zone based on the received signal; the wristwatch operates in a reduced power consumption mode when not receiving a signal and updating the information about the time associated with the second time zone based on the received signal; and the timekeeping assembly receives the signal and updates the information about the time associated with the second time zone based on the received signal in response to actuation of the control by the user, whereby the wristwatch operates a majority of the time in the reduced power consumption mode.

In another feature, the time associated with the second time zone that is displayable in the second area comprises a local time of the area in which the wristwatch is geographically located; the case further comprises a receiver configured to receive a signal by which a local time of the area in which the wristwatch is geographically located may be determined; and the timekeeping component that maintains the information about the time associated with the second time zone automatically receives the signals and updates the information about the time associated with the second time zone based on the received signals without prompting by the user. The case may further include a transmitter configured to transmit a signal indicative of the information about the time associated with the second time zone and, moreover, the transmitter may be configured to blindly transmit the signal at periodic intervals for receipt by other chronometric apparatus.

In another feature, the face further comprises a digital date display that shows information regarding the date.

In another feature, the face further displays information that identifies the second time zone.

In another feature of this aspect, the first time zone corresponds to the time zone that encompasses the home of the user.

In addition to the aforementioned aspects and features of the present invention, it should be noted that the present invention further encompasses the various possible combinations and subcombinations of such aspects and features, including those of any priority document incorporated herein by reference. Thus, for example, any aspect may be combined with an aforementioned feature in accordance with the present invention without requiring any other aspect or feature.

BRIEF DESCRIPTION OF THE DRAWINGS

One or more preferred embodiments of the present invention now will be described in detail with reference to the accompanying drawings, wherein.

DETAILED DESCRIPTION

Figure 1:
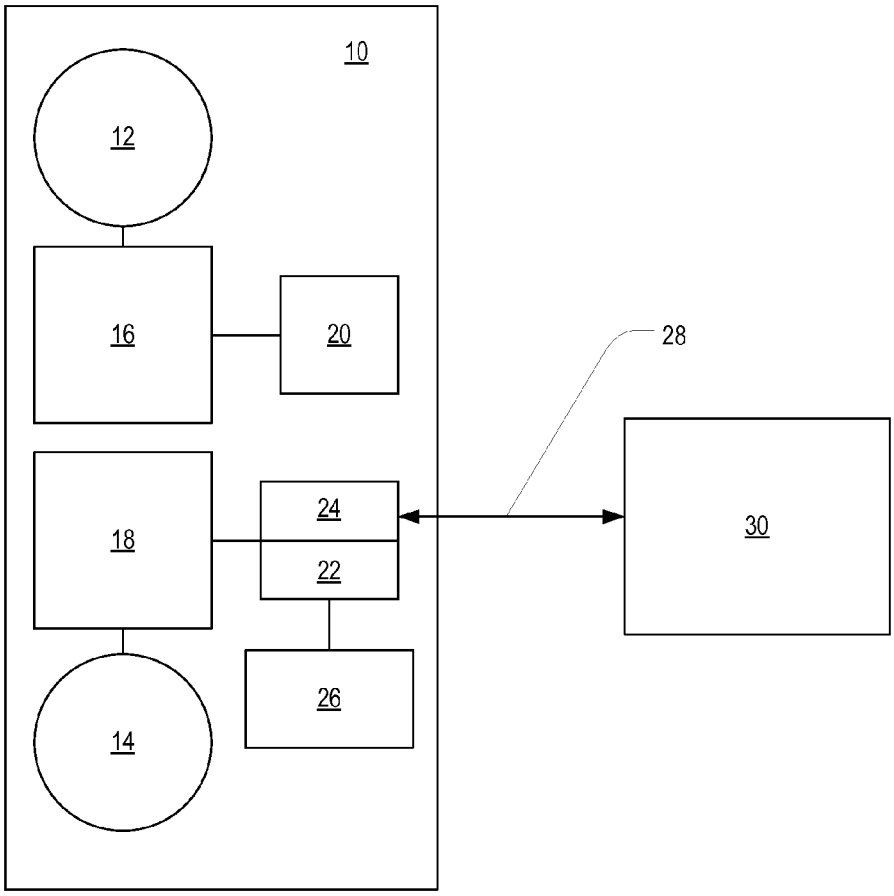
FIG. 1 is a block diagram of a multi-display chronometric apparatus in accordance with a preferred embodiment of the invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Furthermore, the present invention sometimes has been described herein in terms of various functional components and processing steps. It will be appreciated that such components and steps may be realized by any number of hardware components and software features configured to perform the specified functions. A chronometric apparatus may be mechanical, electrical, electronic, electromechanical, optical, chemical, astronomical, or any combination thereof and include means or combination of means of maintaining the passage of time, including extended time or dates which determine the applicability of Daylight Savings Time (DST) adjustments. Moreover, portability of a chronometric apparatus may refer to the ability of the apparatus to be moved from one location to a different location, including semi-portable objects that are not typically moved as well as those that are worn or otherwise carried on one's person.

Referring now to the drawings, one or more preferred embodiments of the present invention are next described. The following description of one or more preferred embodiments is merely exemplary in nature and is in no way intended to limit the invention, its implementations, or uses.

A First Preferred Embodiment

Turning now to the drawings, FIG. 1 is a block diagram of a multi-time display chronometric apparatus 10 in accordance with a preferred embodiment of the invention. The apparatus 10 includes two time displays 12,14. It will be appreciated that other embodiments may include more than two displays. Of the two displays, one display is designated as the home display 12, and the second display is designated as the travel display 14. Each display 12,14 reflects the time as kept by a respective separate clock 16,18. The time kept by the "home" clock 16 is shown on the home display 12, and the time kept by the "travel" clock 18 is shown on the travel display 14. The home clock 16 includes a manual control 20 that enables a user to manually adjust the time displayed on the home display 12. The travel clock 18 includes a processor 22, a receiver 24, and a control 26.

Assuming both clocks are accurately set to a user's home time prior to the user traveling and that the receiver has not been activated by a user via the control 26, both displays 12,14 in this example will show the user's home time. As the user travels to a different time zone or to a region having different local time rules, e.g., no observance of Daylight Savings Time, the home time will remain displayed on both the home display 12 and the travel display 14. However, upon operating the control 26 by the user, an automatic updating function is activated that enables the travel clock 18 to receive a time signal 28 from a time transmitting source 30 via the receiver 24. After receiving the signal 28, the travel clock 18 processes the signal 28 via the processor 22 to determine the time indicated by the signal 28 and then automatically updates the time kept by the travel clock 18 to be the correct local time at the user's current location. This updated time then is displayed on the travel display 14. Meanwhile, the home display 12 continues to show the home time. Because the travel clock is updated when the user actuates the control 26, the travel clock 18 is deemed herein to be updated on demand by the user. Notably, the travel clock does not update of its own accord at periodic intervals or otherwise (in this example), but only upon demand via the user control 26. As such, power consumption resulting from the reception and/or processing of the signal 28 is kept to a minimum and the travel clock 18 is updated only as needed per the user.

Alternatively, in at least one variation of this embodiment, the user enables continuous, periodic updating by actuating the on/off control 26 and thus activating the receiver 24 and processor 22 putting the apparatus 10 into a "receive" mode for receiving the time signal 28 transmitted from a time transmitting source 30. In this variation, the receiver 24 remains activated until the user deactivates it via the on/off control 26, permitting the apparatus 10 to periodically search for and receive the remote signal 28. Alternatively, the receiver 24 may continue in the receive mode until the control 26 is actuated again, or may automatically deactivate after a set time interval, and thereafter remain deactivated until reactivated by the user via the control 26.

It will be appreciated that on/off control 26 can take many forms, such as a depressable push button; an on/off switch; a twistable dial; a touchscreen; and any other means known by one having ordinary skill in the relevant art.

Figure 2:
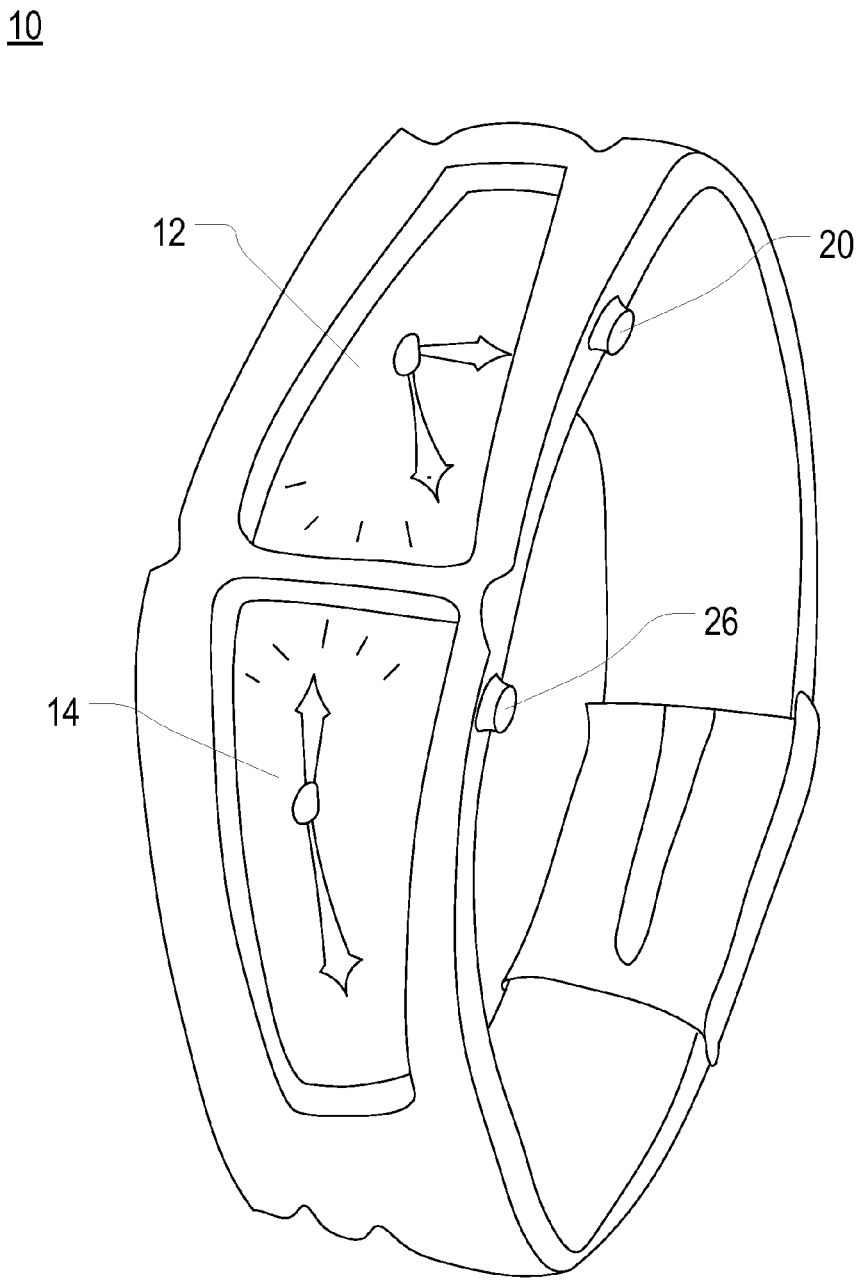
FIG. 2 illustrates a wristwatch representative of the multi-display chronometric apparatus of FIG. 1.

FIG. 2 is a perspective view of an exemplary chronometric apparatus of FIG. 1 in the form of a woman's wristwatch having a dual-display representing the home clock and the travel clock.

A Second Preferred Embodiment

Figure 3:
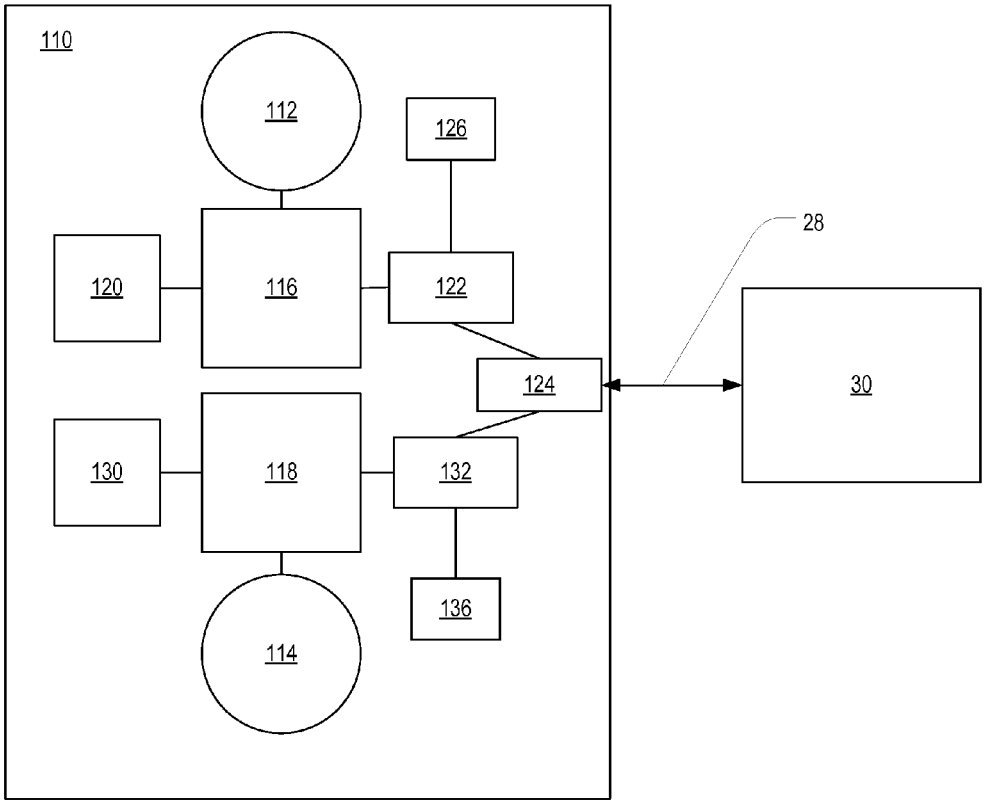
FIG. 3 is a block diagram of a multi-display chronometric apparatus in accordance with another preferred embodiment of the invention.

FIG. 3 is a block diagram of a multi-display chronometric apparatus 110 in accordance with a second preferred embodiment of the invention. As with the embodiment of FIG. 1, the chronometric apparatus 110 may take the form of any consumer time keeping device, including wristwatches, free-standing or mountable clocks, automobile clocks, and consumer electronic devices such as cellular telephones, smartphones (like the iPhone) or similar devices (like the iPod Touch), personal digital assistants, etc.

The chronometric apparatus 110 includes a first time display 112 and a second time display 114, either or both of which may be digital or analog; however, it will be appreciated that other embodiments may feature more than two displays. In this embodiment of the apparatus 110, both of the time displays 112,114 include an automatic updating feature that a user may activate. Effectively, this allows the user to designate either time display 112,114 to feature automatically updated time, or alternatively, designate both displays 112,114 as featuring automatically updated time.

The apparatus 110 includes a first clock 116 and a second clock 118, each of which independently calculate and measure the passage of time, and a receiver 124. The clocks 116,118 may be separate physical clocks, or alternatively, they may be virtual clocks created by one or more software programs or subroutines, or by integrated circuitry. Accordingly, it will be appreciated that reference to "clock" herein encompasses these possible variations and that FIG. 3, for example, is a block diagram generic to these variations.

The first clock 116 includes a first time display 112, a first manual control 120, a first processor 122, and a first on/off control 126. The second clock 118 includes a second time display 114, a second manual control 130, a second processor 132, and a second on/off control 136. Moreover, while shown as separate components for ease of illustration, the processors 122,132 could be combined into a single processor for use with both clocks 116,118 with appropriate computer-executable instructions for interfacing with each clock 116,118.

Assuming both clocks are accurately set prior to a user's home time prior to traveling and that the receiver 124 has not been activated, both displays 112,114 will show the user's home time. As the user travels to a different time zone or to a region having different local time rules, e.g., no observance of Daylight Savings Time, the home time will remain displayed on both the first display 112 and the second display 114. At this point the user can choose which clock to automatically update with the local time of the area in which the user is located.

Assuming the user chooses to update the first clock 116, the user selects the first clock 116 for showing the current local time by actuating the first on/off control 126, which enables the automatic updating function by activating the first processor 122 and the receiver 124. This enables the first clock 116 to receive a time signal 28 from a time transmitting source 30 via the receiver 124. After receiving it, the first clock 116 processes the time signal 28 via the processor 122 and automatically updates the time maintained by the first clock 116 with the correct local time at the user's current location. This updated time can then be viewed on the first display 112. Meanwhile, the second display 114 continues to show the home time.

A similar procedure is followed to alternatively update the second clock 118 and keep the first clock 116 on the user's home time by the user triggering the second on/off control 136 instead of the first on/off control 126.

In at least one variation of this embodiment, the automatic updating function is activated by the user via the respective controls 126,136, enabling the apparatus 110 to enter a "receive" mode to search for and receive a remote signal 28 containing current local time information and update the desired clock 112,114 corresponding to the control 126,136 that was activated. In this variation the automatic updating function remains activated until the user deactivates it, permitting the apparatus 110 to periodically search for and receive remote signals 28 on an ongoing basis.

Figure 4:
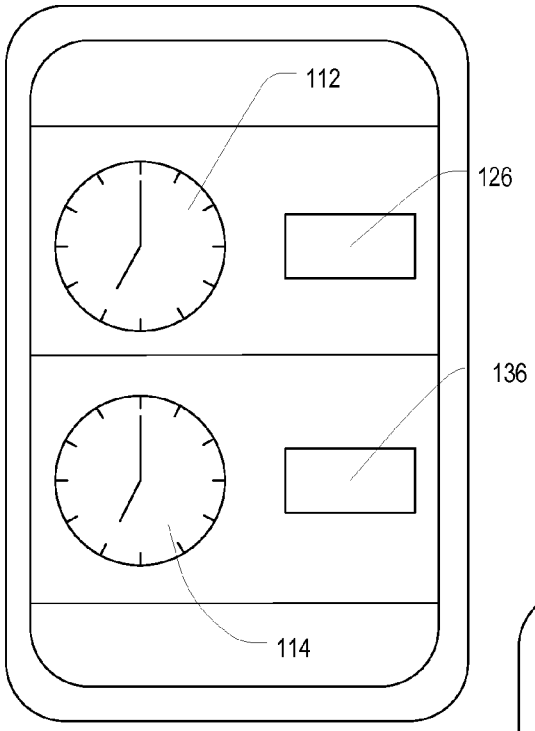
FIGS. 4-5 illustrate a handheld consumer electronic device, such as a smartphone (like an iPhone) or similar device (like an iPod Touch), that is representative of the multi-display chronometric apparatus of FIG. 3.
Figure 5:
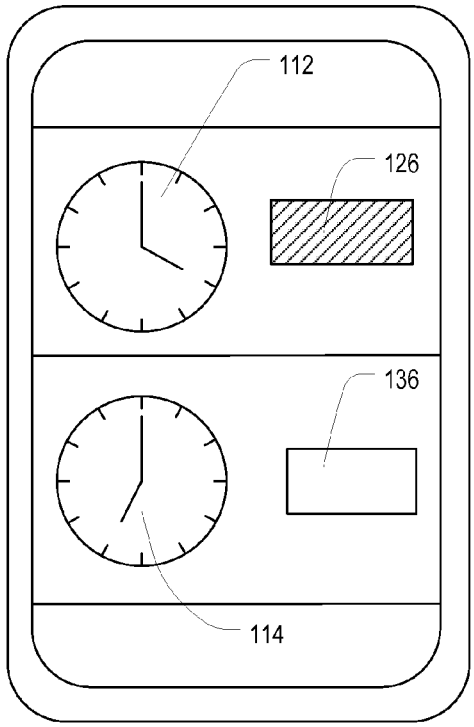

FIGS. 4-5 illustrate a smartphone (like an iPhone) or a similar device (like an iPod Touch) that is representative of the multi-display chronometric apparatus 110 of FIG. 3. In particular, FIG. 4 shows the first display 112 and second display 114 prior to being updated, wherein both displays show the time as being 7:00. The same device is shown in FIG. 5, wherein a user has triggered the first on/off control 126 (denoted by the hatched lines), thus activating a processor 122 and receiver 124 for receiving a time signal 28. Based on the determination of the local time via the signal, the first display 112 is thereafter updated to show the current local time of 4:00 while the second display 114 continues to show the original home time of 7:00. Preferably, the receiver then automatically deactivates after the update is complete.

In alternate variations, the automatic updating function is activated by the user, enabling the apparatus to enter a temporary "receive" mode to search for and receive remote signals containing current local time information. However, in this variation, the updating function automatically deactivates after a set time interval or upon receiving a predetermined number of remote time signals (one or more). The updating function then preferably remains deactivated until reactivated by the user.

Figure 6:
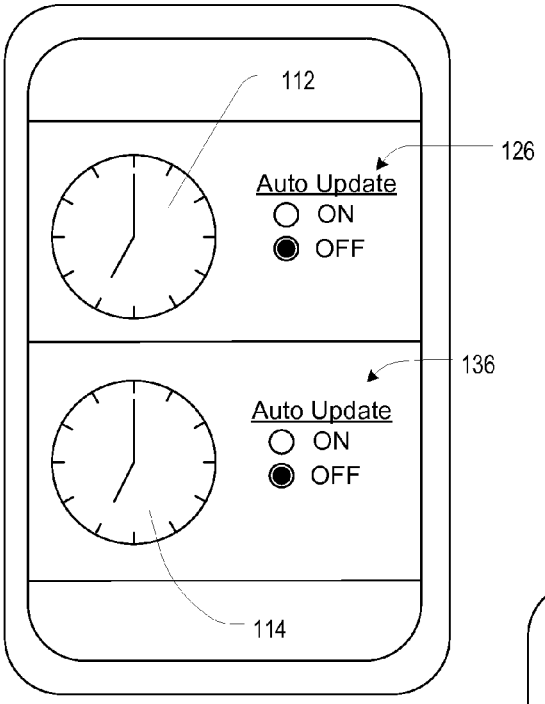
FIGS. 6-7 illustrate another handheld consumer electronic device that is representative of the multi-display chronometric apparatus of FIG. 3.
Figure 7:
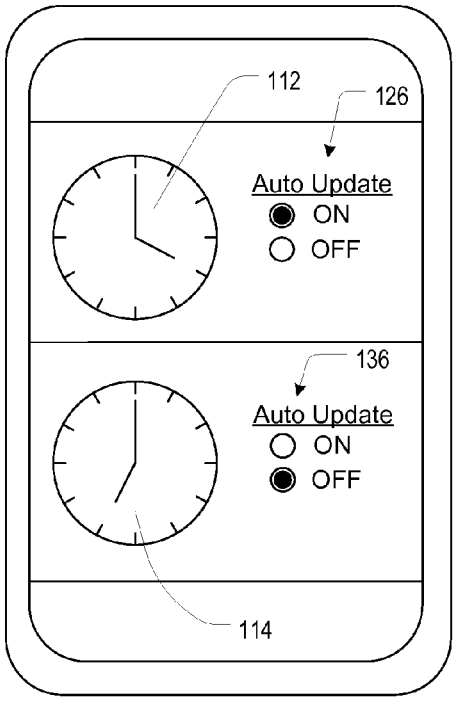

FIGS. 6-7 also illustrate a smartphone (like an iPhone) or a similar device (like an iPod Touch) that is representative of the multi-display chronometric apparatus 110 of FIG. 3.

FIG. 6 shows the first display 112 and second display 114 after a user has traveled to a different time zone with the device but prior to being updated, wherein both displays show the time as being 7:00.

FIG. 7 shows the result after a user triggers the first on/off control 126. The first display 112 shows the current local time of 4:00 and the second display 114 shows the original home time of 7:00. In this variation, the receiver will stay on and continue to automatically update as the user changes time zones or local time rules, as indicated by received signals 28.

It will be appreciated that on/off controls 126,136 can take many forms, such as depressible push buttons, on/off switches, twistable dials, touch screens, and any other means considered appropriate by one having ordinary skill in the relevant art.

It will further be appreciated that there are many possible means of indicating which display is communicating the "home" time and which display is communicating the "travel" time. Examples of such means include: color schemes, text indication, positioning of the displays, and any other means considered appropriate by one having ordinary skill in the relevant art. Similar methods can be used to indicate whether the time shown by a particular display is AM or PM.

Furthermore, in a variation of the foregoing apparatus, the apparatus may be programmed such that only one of the displays is automatically updated when the apparatus travels into another time zone. In this respect, selecting one of the displays for showing the "home time" preferably deselects the other display, and vice-versa, such that the two displays toggle back and forth between showing the home time.

A Third Preferred Embodiment

Figure 8:
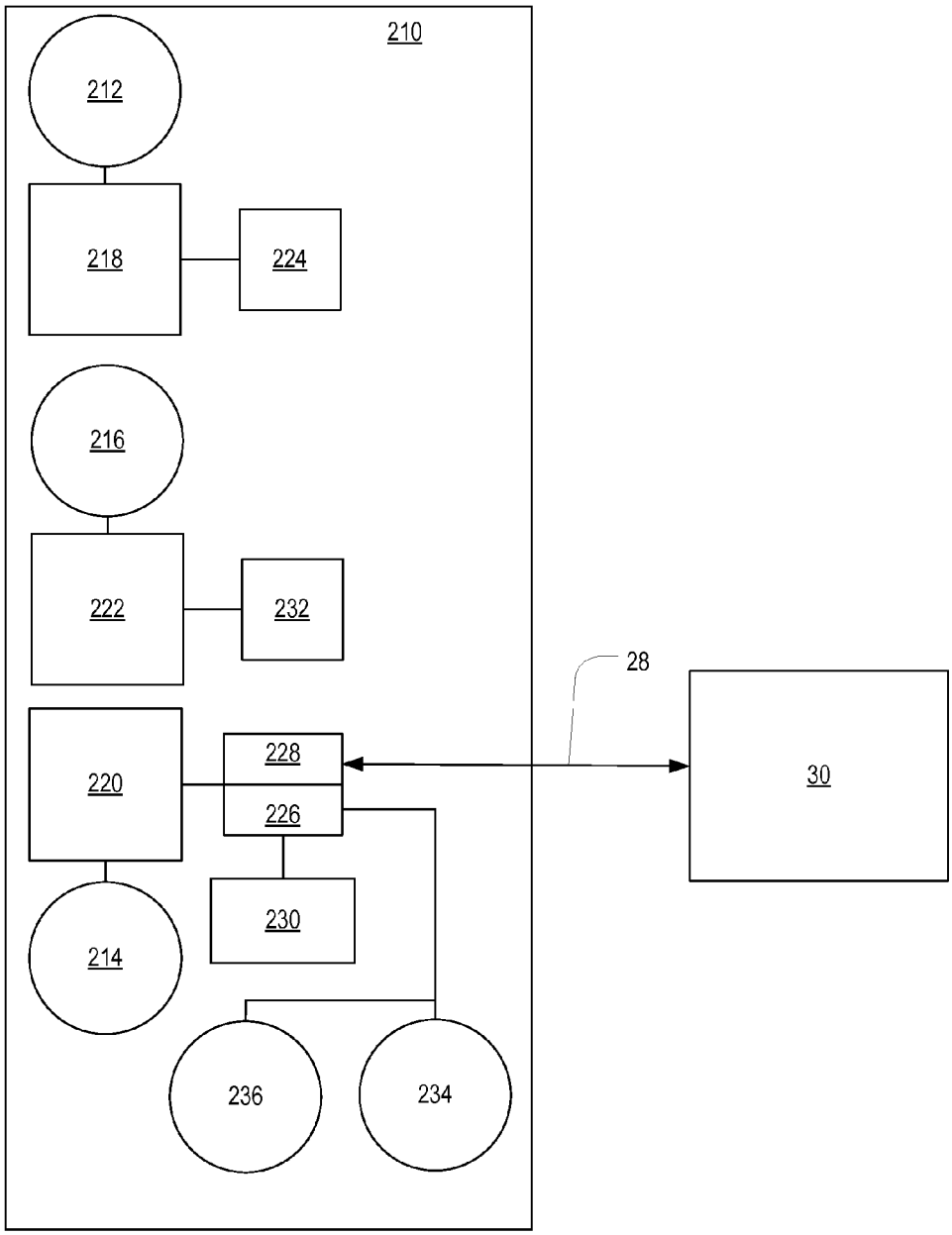
FIG. 8 is a block diagram of a chronometric apparatus in accordance with another preferred embodiment of the invention.
Figure 9:
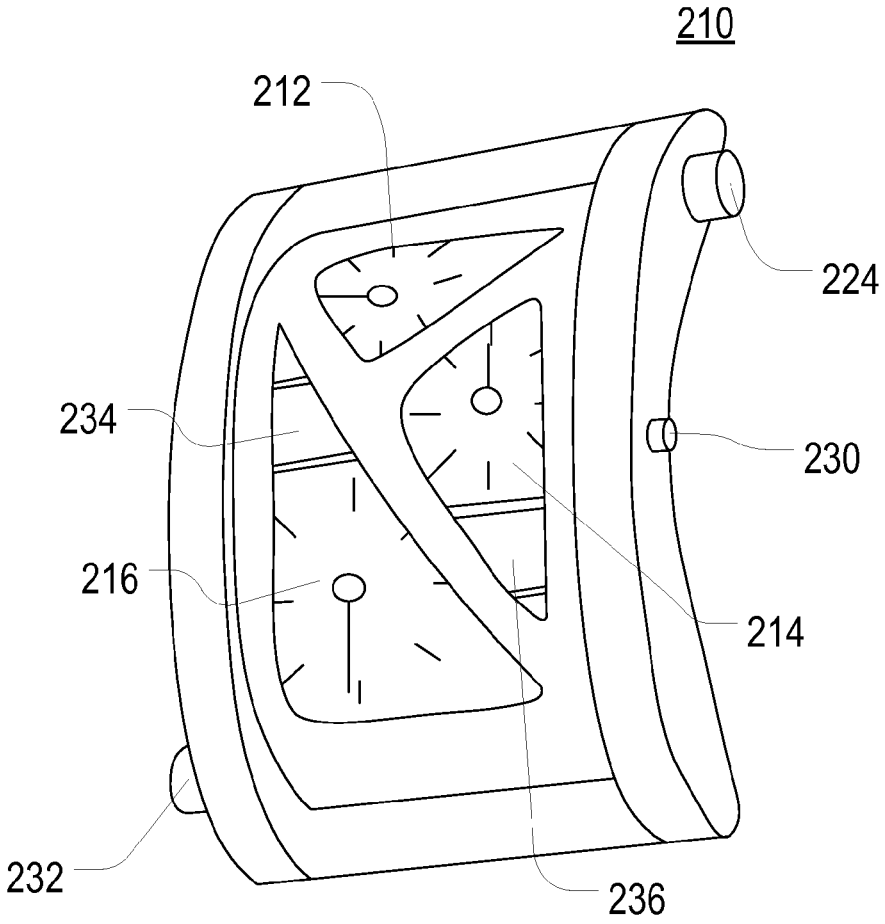
FIG. 9 is a perspective view of a multi-display chronometric apparatus representative of that of FIG. 8 that is embodied as a woman's wristwatch, wherein the case and face of wristwatch are shown in a perspective view but a band of the wristwatch is omitted.
Figure 9A:
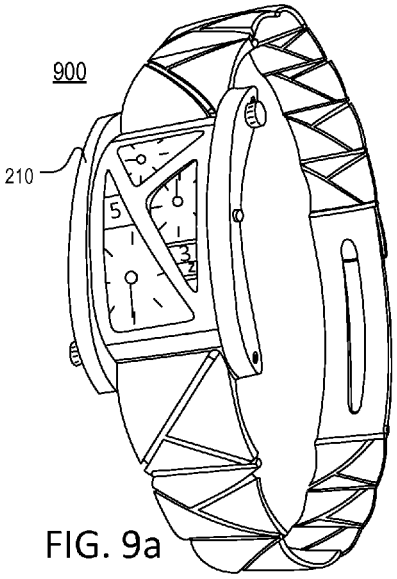
FIG. 9*a* is a perspective view of the wristwatch of FIG. 9*a*, including the band.
Figure 9B:
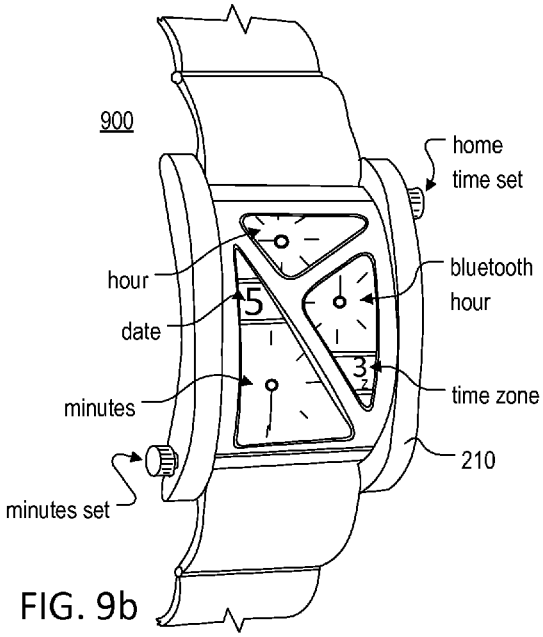
FIG. 9*b* is a perspective view of the wristwatch of FIG. 9*a*, including the band.
Figure 9C:
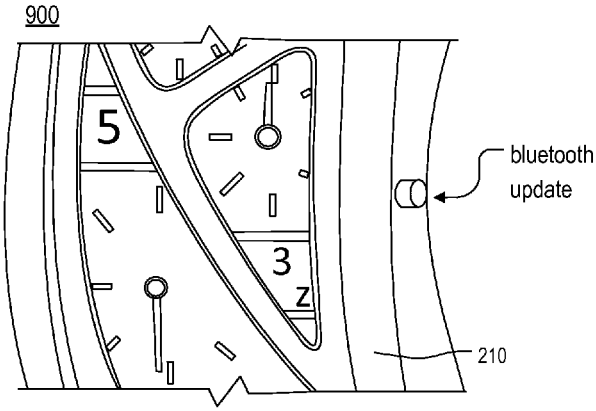
FIG. 9*c* is a close-in perspective view of the face of the case of the wristwatch of FIG. 9*a*.
Figure 9D:
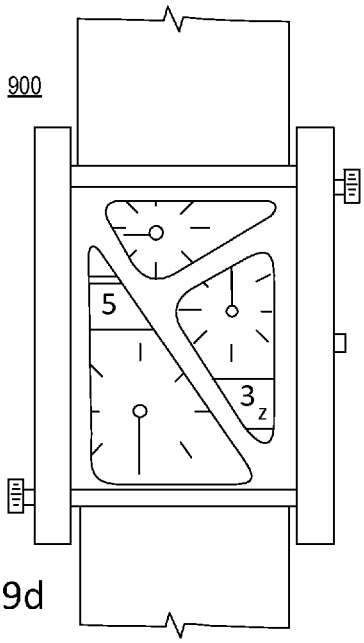
FIG. 9*d* is a plan view of a face of the wristwatch of FIG. 9*a*.

FIG. 8 is a block diagram of a multi-display chronometric apparatus 210 in accordance with a third preferred embodiment of the invention, and is illustrative of a chronometric apparatus having three primary displays. FIG. 9 is a perspective view of the chronometric apparatus 210 of FIG. 8 embodied as a woman's wristwatch 900 (shown without a band in FIG. 9, but shown with an exemplary band in FIGS. 9*a*, 9*b*, and 9*d*).

With reference to FIGS. 8, 9, and 9*a*-9*d*, the chronometric apparatus 210 includes an analog home time hour display 212, an analog travel time hour display 214, and an analog minute display 216, all of which are physically separate and compartmentalized from one another. Each display reflects the time as kept by a respective separate clock 218,220,222. The time kept by the "home" clock 218 is shown on the home time hour display 212, while the time kept by the "travel" clock 220 is shown on the travel time hour display 214. Each of the home time hour display 212 and travel time hour display 214 have only a single hour hand, as it is most likely that the differences between time zones will be on the order of hours and not minutes. The time kept by the "minute" clock 222 is shown on the minute display 216 and is intended to be applicable to either of the time zones.

The home time hour clock 218 includes a home time manual control 224 that enables a user to manually adjust the hour displayed on the home time hour display 212. The travel clock 220 includes a processor 226, a receiver 228, and a travel time update control 230 associated therewith. The minute clock 222 includes a minute manual control 232 that enables a user to manually adjust the minutes displayed on the minute display 216. The apparatus further includes a digital date display 234 that shows the date of the month (or alternatively, any common format for the date), and a digital time zone display 236 that shows information pertaining to the particular time zone that is represented by the analog travel time hour display 214. Preferably, the information identifies the particular time zone. Such identification may be by way of the appropriate abbreviation of the time zone. Common abbreviations include, for example, EDT for "Eastern Daylight Time"; EST for "Eastern Standard Time"; MDT for "Mountain Daylight Time"; MST for "Mountain Standard Time"; PDT for "Pacific Daylight Time"; and PST for "Pacific Standard Time". Other possible identifiers could include the value of the hour offset to Universal Coordinated Time (UTC) or Greenwich Mean Time (GMT), or corresponding abbreviation thereof.

Assuming all clocks 218,220,224 are accurately set to represent a user's home time prior to traveling and that the receiver 228 has not been activated, both the home time hour display 212 and the travel time hour display 214 will show the user's home time and the minute display 216 generally will show the correct minute of the hour (especially when traveling within the continental United States). As the user travels to a different time zone or to a region having different local time rules, e.g., no observance of Daylight Savings Time, the home time will remain displayed on both the home time hour display 212 and the travel time hour display 214. However, upon operating the travel time update control 230 by the user, an automatic updating function is enabled, making the travel time hour clock 220 capable of receiving a time signal 28 from a time transmitting source 30 via the receiver 228. After receiving the signal, the travel clock 220 processes the signal 28 via the processor 226 and automatically updates the time kept by the travel clock 220 to be the correct local time at the user's current location. This updated time, which in this example is the hour of this updated time, then is displayed on the travel time hour display 214. Meanwhile, the home time hour display 212 continues to show the hour of the home time. Moreover, the minute display continues to show the correct minute that is generally applicable to both the home time and the time of the area to which the user has traveled.

Because the travel clock 220 is updated when the user actuates the travel time update control 230, the travel clock 220 is deemed herein to be updated on demand by the user. Notably, the travel clock 220 does not update of its own accord at periodic intervals or otherwise in this example, but only upon demand through the control 230. As such, power consumption resulting from the reception and/or processing of the signal 28 is kept to a minimum and the travel clock 220 is updated only as needed per the user.

In at least one variation of this embodiment, the automatic updating function is activated by the user, enabling the apparatus 210 to enter a "receive" mode to search for and receive a remote signal 28 containing current local time information. In this variation the automatic updating function remains activated until the user deactivates it, permitting the apparatus 210 to periodically search for and receive remote signals 28 on an ongoing basis.

It will be appreciated that travel time update control 230 can take many forms, such as a depressible push button; an on/off switch; a twistable dial; a touchscreen; and any other means known by one having ordinary skill in the relevant art.

Possible Methods of Updating the Current Local Time Displayed

It will be appreciated by one having skill in the relevant art that many different technologies and wireless communication methods may be represented by time transmitting source 30 in enabling the auto updating features disclosed above. Such technologies include GPS communications, which include time information as well as location information; radio tower transmissions that include time and/or location information; wireless network communications (including WiFi and WiMax communications) that include time and/or location information or that enable network communications, such as via the Internet, for acquiring time and/or location information; and mobile communications including cellular and/or satellite communications. Moreover, a chronometric apparatus may include Bluetooth capabilities for communicating with a separate consumer electronic device such as a user's or third party's cellular phone, other consumer electronic device, or even a personal computer, for effecting network communications and/or for acquiring time information itself directly from such device. Indeed, the newest Bluetooth products are believed to provide a high level of integration by integrating IEEE 802.11b/g and Bluetooth 2.0+EDR into a single MAC/Baseband chip utilizing a single 2.4 GHz transceiver. The small size of Bluetooth devices allows watches and other timepieces to contain Bluetooth technology and continue to maintain an ultra compact design and form. Further in this regard, the use of Bluetooth communications to acquire local time information via signals 28 is believed to be preferred. Moreover, this preference is reflected in FIGS. 9*b* and 9*c*, wherein the travel time hour display is indicated as "bluetooth hour" and the travel time update control is indicated as "bluetooth update". In an exemplary implementation, a user's iPhone is paired with the chronometric apparatus whereby the chronometric apparatus is able to obtain the local time information from the iPhone.

An Additional Preferred Embodiment

Figure 10:
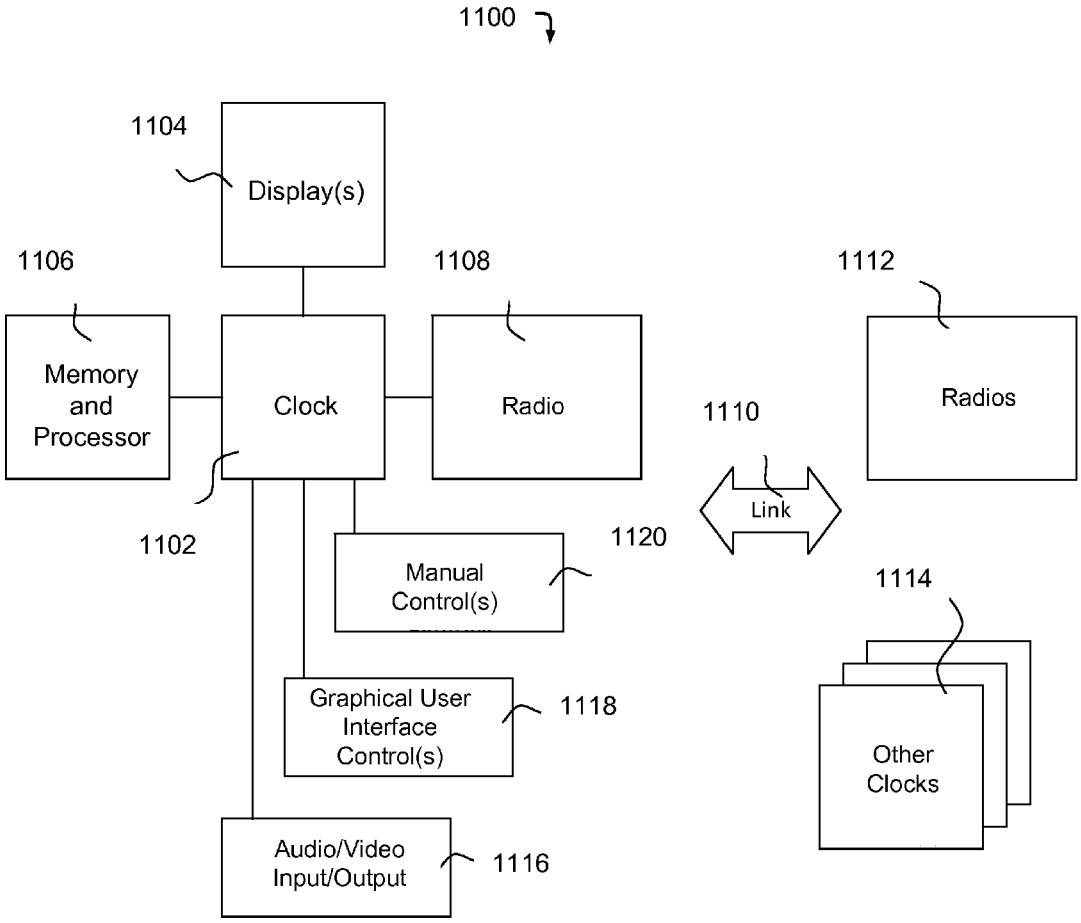
FIG. 10 is a block diagram of a system that includes a multi-display chronometric apparatus in accordance with yet another preferred embodiment of the invention.

With reference to FIG. 10, a system 1100 that includes a chronometric apparatus in accordance with another preferred embodiment is illustrated. The chronometric apparatus includes a chronometric component or "clock" 1102 attached to one or more displays 1104, which displays 1104 reflect time and other information in digital and/or analog form. A memory and processor 1106 are used for computations and to store information, including data on locations (e.g., maps), and associated time zones and daylight savings time (DST) regions. A transceiver or other radiofrequency (RF) component 1108 is used to establish wireless communications 1110 with external transceivers or other RF components 1112, including those of other similar chronometric apparatus 1114. At a minimum, radio component 1108 comprises a receiver for receiving transmissions from external transmitters, but preferably includes a transmitter for making transmissions.

Such remote communications from the one or more radios 1112 and other chronometric apparatus 1114 convey location and/or correct time information to the chronometric apparatus including clock 1102. Such communications may include: GPS communications, with low power or time multiplexed circuits at the apparatus, with the small size and low cost suitable for a watch or miniature battery driven clock; WiFi communications and programming to get location and then time information, or time directly; direct satellite links or LORAN links; cellular phone links for relatively long haul information gathering plus a short range radio link such as Bluetooth communications for compact, low-power, and low cost transfer of data to the apparatus; a proprietary set of transmitters 1112 with unique identification codes, i.e., a "watch network", which allows a minimal listen-only type circuit included in apparatus to identify its location; a wireless communication link which simply transmits the correct local time, e.g., if mounted inside an airplane; and/or a peer-to-peer network ("clock-to-clock" or "watch-to-watch") whereby a sampling of clocks in the near vicinity allows a statistical determination and subsequent adjustment of time to the correct local time.

In accordance with alternative or additional features, and with continuing reference to FIG. 10, an audio and/or video interface and processing 1116 allows the following methods: a microphone and processing which allows auto-detection of the time via passive listening or via active requests for the correct time via loudspeaker, including acquiring unique auditory clues; a video camera or still frame camera which allows autodetection of the time via imaging to detect clocks and ascertain their time reading(s), including dynamic readings and processing; a audio means for a user to directly speak their location or even the correct time into the apparatus; and a video means for a user to directly assist in imaging his or her location, or even the correct time into the apparatus, including directly imaging the faces or displays of clocks, text, data, landmarks and any other useful information.

The apparatus further may include a graphical user interface 1118, including a remotely located one that communicates wirelessly with the apparatus, which allows the user to enter his or her location and/or local time; and one or more manual controls 1120, such as dedicated buttons, which allows a user to directly input and adjust hour and/or minute information, and/or time zone information.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A system comprising a plurality of local-time aware, multi-display chronometric apparatus, each having a plurality of displays for displaying time, the system including:

(a) a first local-time aware, multi-display chronometric apparatus comprising
  (i) a first display for displaying time associated with a first time zone,
  (ii) a second display for displaying time associated with a second time zone, and
  (iii) a timekeeping assembly comprising at least one timekeeping component configured to keep time, the time keeping assembly arranged such that the passing of time is displayed by the first display and the second display, (b) a second local-time aware, multi-display chronometric apparatus comprising
  (i) a first display for displaying time associated with a first time zone,
  (ii) a second display for displaying time associated with a second time zone, and
  (iii) a timekeeping assembly comprising at least one timekeeping component configured to keep time, the time keeping assembly arranged such that the passing of time is displayed by the first display and the second display;

(c) wherein the first chronometric apparatus is configured to receive, from the second chronometric apparatus, when the second chronometric apparatus is disposed nearby, a signal by which a local time of the area in which the first chronometric apparatus is geographically located may be determined, and update one of the first display and the second display of the first chronometric apparatus with a received local time but not update the other of the first display and the second display of the first chronometric apparatus;

(d) wherein the first timekeeping apparatus includes a wireless transmitter configured to transmit, to the second chronometric apparatus when the second chronometric apparatus is disposed nearby, a signal indicative of the local time of the area in which the first chronometric apparatus is geographically located;

(e) wherein the second chronometric apparatus is configured to receive, from the first chronometric apparatus, when the first chronometric apparatus is disposed nearby, a signal by which a local time of the area in which the second chronometric apparatus is geographically located may be determined, and update one of the first display and the second display of the second chronometric apparatus with a received local time but not update the other of the first display and the second display of the second chronometric apparatus;

(f) wherein the second timekeeping apparatus includes a wireless transmitter configured to transmit, to the first chronometric apparatus when the first chronometric apparatus is disposed nearby, a signal indicative of the local time of the area in which the second chronometric apparatus is geographically located;

(g) wherein the timekeeping assembly of the first chronometric apparatus includes a control by which a user of the first chronometric apparatus selects which of the first display and the second display is updated by the updater, whereby the selected one of the first display and the second display shows the local time of the area in which the first chronometric apparatus is geographically located as determined based on a received signal while the time displayed by the other of the first display and the second display remains unchanged;

(h) wherein the timekeeping assembly of the second chronometric apparatus includes a control by which a user of the second chronometric apparatus selects which of the first display and the second display is updated by the updater, whereby the selected one of the first display and the second display shows the local time of the area in which the second chronometric apparatus is geographically located as determined based on a received signal while the time displayed by the other of the first display and the second display remains unchanged;

(i) wherein the multi-display first chronometric apparatus is capable of being carried on one's person;

(j) wherein the multi-display second chronometric apparatus is capable of being carried on one's person, (k) wherein the first chronometric apparatus is configured to receive a plurality of signals from other chronometric apparatus and make a statistical determination based on information contained in the received plurality of signals as to a correct local time; and (l) wherein the second chronometric apparatus is configured to receive a plurality of signals from other chronometric apparatus and make a statistical determination based on information contained in the received plurality of signals as to a correct local time.

2. The system of claim 1, wherein, in at least one of the first and second chronometric apparatus, only one of the first display and the second display is selectable at a time, via the control, for displaying the local time.

3. The system of claim 1, wherein, in at least one of the first and second chronometric apparatus, selection of the first display, via the control, for displaying the local time causes the second display to display a time associated with a predetermined time zone.

4. The system of claim 1, wherein, in at least one of the first and second chronometric apparatus, selection of the second display, via the control, for displaying the local time causes the first display to display a time associated with a predetermined time zone.

5. The system of claim 4, wherein selection of the first display, via the control of the first chronometric apparatus, for displaying the local time causes the second display to display a time associated with a predetermined time zone.

6. The system of claim 1, wherein, in at least one of the first and second chronometric apparatus, the timekeeping assembly automatically receives the signals and updates at least one of the first and second displays to display the local time as determined by the received signal without prompting by the user.

7. The system of claim 1, wherein, in at least one of the first and second chronometric apparatus, the timekeeping assembly receives the signals and updates at least one of the first and second displays to display the local time as determined by the received signal upon prompting by the user.

8. The system of claim 1, wherein, in at least one of the first and second chronometric apparatus, the transmitter is configured to blindly transmit signals indicative of the local time at periodic intervals for receipt by other chronometric apparatus.

9. The system of claim 8, wherein, in at least one of the first and second chronometric apparatus, the at least one apparatus further comprising a control, operable by the user, for activating and deactivating the transmitter.

10. The system of claim 1, wherein, in at least one of the first and second chronometric apparatus, the chronometric apparatus comprises a wristwatch.

11. The system of claim 1, wherein, in at least one of the first and second chronometric apparatus, the chronometric apparatus comprises a handheld electronic device.

12. A system comprising a plurality of local-time aware, multi-display chronometric apparatus, each having a plurality of displays for displaying time, the system including:

(a) a first local-time aware, multi-display chronometric apparatus comprising
  (i) a first display for displaying time associated with a first time zone,
  (ii) a second display for displaying time associated with a second time zone, and
  (iii) a timekeeping assembly comprising at least one timekeeping component configured to keep time, the time keeping assembly arranged such that the passing of time is displayed by the first display and the second display, (b) a plurality of other local-time aware, multi-display chronometric apparatus each comprising
  (i) a first display for displaying time associated with a first time zone,
  (ii) a second display for displaying time associated with a second time zone, and
  (iii) a timekeeping assembly comprising at least one timekeeping component configured to keep time, the time keeping assembly arranged such that the passing of time is displayed by the first display and the second display;

(d) wherein the first chronometric apparatus is configured to receive, from each of the other chronometric apparatus, when the other chronometric apparatus are disposed nearby, a signal for use in determining a local time of the area in which the first chronometric apparatus is geographically located, and update one of the first display and the second display of the first chronometric apparatus with a determined local time but not update the other of the first display and the second display of the first chronometric apparatus;

(e) wherein the first timekeeping apparatus includes a wireless transmitter configured to transmit, to the other chronometric apparatus when the other chronometric apparatus are disposed nearby, a signal indicative of the local time of the area in which the first chronometric apparatus is geographically located;

(f) wherein the timekeeping assembly of the first chronometric apparatus includes a control by which a user of the first chronometric apparatus selects which of the first display and the second display is updated by the updater, whereby the selected one of the first display and the second display shows the local time of the area in which the first chronometric apparatus is geographically located as determined based on received signals from the other chronometric apparatus while the time displayed by the other of the first display and the second display remains unchanged;

(g) wherein the first chronometric apparatus includes a control, operable by a user of the first chronometric apparatus, for activating and deactivating the wireless transmitter of the first chronometric apparatus;

(h) wherein the multi-display first chronometric apparatus is capable of being carried on one's person;

(i) wherein the first and other chronometric apparatus comprise memory containing computer-executable instructions for
  (i) receiving, at the first chronometric apparatus, user input via the control by which a user of the first chronometric apparatus selects which display of the first display and second display is updated by the updater,
  (ii) transmitting a first signal indicative of a first local time from a first one of the other chronometric apparatus to the first chronometric apparatus,
  (iii) transmitting a second signal indicative of the first local time from a second one of the other chronometric apparatus to the first chronometric apparatus,
  (iv) transmitting a third signal indicative of a second local time from a third one of the other chronometric apparatus to the first chronometric apparatus,
  (v) receiving, at the first chronometric apparatus, the first signal indicative of the first local time transmitted from the first one of the other chronometric apparatus,
  (vi) receiving, at the first chronometric apparatus, the second signal indicative of the first local time transmitted from the second one of the other chronometric apparatus,
  (vii) receiving, at the first chronometric apparatus, the third signal indicative of the second local time transmitted from the third one of the other chronometric apparatus,
  (viii) automatically statistically determining, based on information contained in the received first, second, and third signals, a correct local time,
  (ix) updating, at the first chronometric apparatus, the display of the first display and second display that was indicated for updating by the received user input to show the local time based on the automatic statistical determination of the correct local time, but not updating the other display of the first and second display that was not indicated for updating by the received user input, and (x) transmitting a signal indicative of the automatically determined correct local time to another chronometric apparatus of the other chronometric apparatus.

13. The system of claim 12, wherein the first chronometric apparatus comprises a wristwatch.

14. The system of claim 13, wherein the second one of the other chronometric apparatus comprises a handheld electronic device.

15. The system of claim 13, wherein the second one of the other chronometric apparatus comprises a wristwatch.

16. The system of claim 12, wherein the first chronometric apparatus comprises a handheld electronic device.

17. A system comprising a plurality of local-time aware, multi-display chronometric apparatus, each having a plurality of displays for displaying time, the system including:

(a) a first local-time aware, multi-display chronometric apparatus comprising (i) a first display for displaying time associated with a first time zone, (ii) a second display for displaying time associated with a second time zone, and (iii) a timekeeping assembly comprising at least one timekeeping component configured to keep time, the time keeping assembly arranged such that the passing of time is displayed by the first display and the second display, (b) a plurality of other local-time aware, multi-display chronometric apparatus each comprising (i) a first display for displaying time associated with a first time zone, (ii) a second display for displaying time associated with a second time zone, and (iii) a timekeeping assembly comprising at least one timekeeping component configured to keep time, the time keeping assembly arranged such that the passing of time is displayed by the first display and the second display;

(d) wherein the first chronometric apparatus is configured to receive, from each of the other chronometric apparatus, when the other chronometric apparatus are disposed nearby, a signal for use in determining a local time of the area in which the first chronometric apparatus is geographically located, and update one of the first display and the second display of the first chronometric apparatus with a determined local time but not update the other of the first display and the second display of the first chronometric apparatus;

(e) wherein the first timekeeping apparatus includes a wireless transmitter configured to transmit, to the other chronometric apparatus when the other chronometric apparatus are disposed nearby, a signal indicative of the local time of the area in which the first chronometric apparatus is geographically located;

(f) wherein the timekeeping assembly of the first chronometric apparatus includes a control by which a user of the first chronometric apparatus selects which of the first display and the second display is updated by the updater, whereby the selected one of the first display and the second display shows the local time of the area in which the first chronometric apparatus is geographically located as determined based on received signals from the other chronometric apparatus while the time displayed by the other of the first display and the second display remains unchanged;

(g) wherein the first chronometric apparatus includes a control, operable by a user of the first chronometric apparatus, for activating and deactivating the wireless transmitter of the first chronometric apparatus;

(h) wherein the multi-display first chronometric apparatus is capable of being carried on one's person;

(i) wherein the first and other chronometric apparatus comprise memory containing computer-executable instructions for (i) receiving, at the first chronometric apparatus, user input via the control by which a user of the first chronometric apparatus selects which display of the first display and second display is updated by the updater, (ii) transmitting a signal indicative of a local time from a plurality of the other chronometric apparatus to the first chronometric apparatus, (iii) receiving, at the first chronometric apparatus, a plurality of signals indicative of a local time transmitted from the other chronometric apparatus, the signals including signals indicative of two or more different local times, (iv) automatically statistically determining a correct local time of the two or more different local times which is most likely to be accurate, (v) updating, at the first chronometric apparatus, the display of the first display and second display that was indicated for updating by the received user input to show the automatically statistically determined correct local time, but not updating the other display of the first and second display that was not indicated for updating by the received user input, and (vi) transmitting a signal indicative of the automatically statistically determined correct local time to another chronometric apparatus.

18. The system of claim 17, wherein the first chronometric apparatus comprises a wristwatch.

19. The system of claim 17, wherein the first chronometric apparatus comprises a handheld electronic device.

* * * * *